US010960675B2

(12) United States Patent
Rosario et al.

(10) Patent No.: US 10,960,675 B2
(45) Date of Patent: Mar. 30, 2021

(54) SUPPLY RETAINERS WITH RETENTION CLIPS

(71) Applicant: Hewlett-Packard Development Company, L.P., Spring, TX (US)

(72) Inventors: Carlos E. Rosario, Aguadilla, PR (US); Segi Gonzalez Sanchez, Aguadilla, PR (US); Eladia Velez Vazquez, Aguadilla, PR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/481,651

(22) PCT Filed: May 31, 2017

(86) PCT No.: PCT/US2017/035203

§ 371 (c)(1),
(2) Date: Jul. 29, 2019

(87) PCT Pub. No.: WO2018/222185

PCT Pub. Date: Dec. 6, 2018

(65) Prior Publication Data

US 2019/0344576 A1 Nov. 14, 2019

(51) Int. Cl.
*B41J 2/17* (2006.01)
*B41J 2/175* (2006.01)

(52) U.S. Cl.
CPC ..... *B41J 2/17523* (2013.01); *B41J 2/17513* (2013.01); *B41J 2/1754* (2013.01); *B41J 2/17553* (2013.01)

(58) Field of Classification Search
None
See application file for complete search history.

(56) References Cited

U.S. PATENT DOCUMENTS 5,433,345 A 7/1995 Sasaki et al.
6,412,663 B1 * 7/2002 Adamson, II ..... A47G 23/0258 220/737

(Continued)

FOREIGN PATENT DOCUMENTS

CN 101190597 6/2008
EP 2127884 12/2009

(Continued)

OTHER PUBLICATIONS

International Searching Authority, "Search Report," issued in connection with PCT Patent application No. PCT/US2017/035203, dated Mar. 7, 2019, 2 pages.

(Continued)

*Primary Examiner* — Erica S Lin
(74) *Attorney, Agent, or Firm* — Hanley Flight & Zimmerman LLC

(57) ABSTRACT

In an example, a supply retainer may include a carton having a spout opening extending to a base edge of the carton. The spout opening may receive a spout of a supply bladder, in some implementations. The supply retainer may also include a retention clip having a retention opening extending to a leading edge of the retention clip to receive and retain the spout. The retention clip may also include a carton slot to slidably engage with a dividing wall of the carton so as to align the spout opening and the retention opening such that the spout may extend through the spout opening and the retention opening.

11 Claims, 8 Drawing Sheets

(56) References Cited

U.S. PATENT DOCUMENTS

| | | | | |
|---|---|---|---|---|
| 7,681,783 | B2 | 3/2010 | Stephenson | |
| 7,874,660 | B2 | 1/2011 | Haines et al. | |
| 8,474,655 | B2 | 7/2013 | Hackleman et al. | |
| 8,567,930 | B2 | 10/2013 | Ogle et al. | |
| 8,632,172 | B2 | 1/2014 | Zaba et al. | |
| 8,696,080 | B2 | 4/2014 | Cerro et al. | |
| 8,746,541 | B2 | 6/2014 | Spivey, Sr. et al. | |
| 2007/0222837 | A1 | 9/2007 | Tajima | |
| 2009/0096836 | A1 | 4/2009 | Haines et al. | |
| 2010/0116824 | A1 | 5/2010 | Stalions | |
| 2010/0208013 | A1* | 8/2010 | Zaba | B41J 2/17553 347/86 |
| 2015/0041494 | A1 | 2/2015 | Brooks | |
| 2015/0232264 | A1 | 8/2015 | Pansegrouw | |
| 2016/0263903 | A1 | 9/2016 | Maeshima | |

FOREIGN PATENT DOCUMENTS

| | | |
|---|---|---|
| EP | 2280828 | 2/2011 |
| JP | 2002225941 | 8/2002 |
| WO | 2006072038 | 7/2006 |
| WO | 2009139761 | 11/2009 |

OTHER PUBLICATIONS

International Searching Authority, "Written Opinion," issued in connection with PCT Patent application No. PCT/US2017/035203, dated Mar. 7, 2019, 4 pages.

HP, "HP Latex 3000 Printer Series," Ink System Components, Mar. 1, 2017, 3 pages.

* cited by examiner

SUPPLY RETAINERS WITH RETENTION CLIPS

RELATED APPLICATION

This patent arises from the U.S. national stage of International Patent Application Serial No. PCT/US2017/035203, having an international filing date of May 31, 2017, which is hereby incorporated by reference in its entirety for all purposes.

BACKGROUND

Imaging devices may perform imaging operations on or with media or print media. Imaging devices may use an imaging substance to perform such imaging operations. The imaging substance may be disposed in an imaging device supply. Such imaging device supplies may be contained within the imaging device, attached to the imaging device, and in some situations, may be disposed remotely relative to the imaging device. Further, such imaging device supplies may be replaced periodically to refresh or refill the imaging substance within.

DETAILED DESCRIPTION

Figure 1:
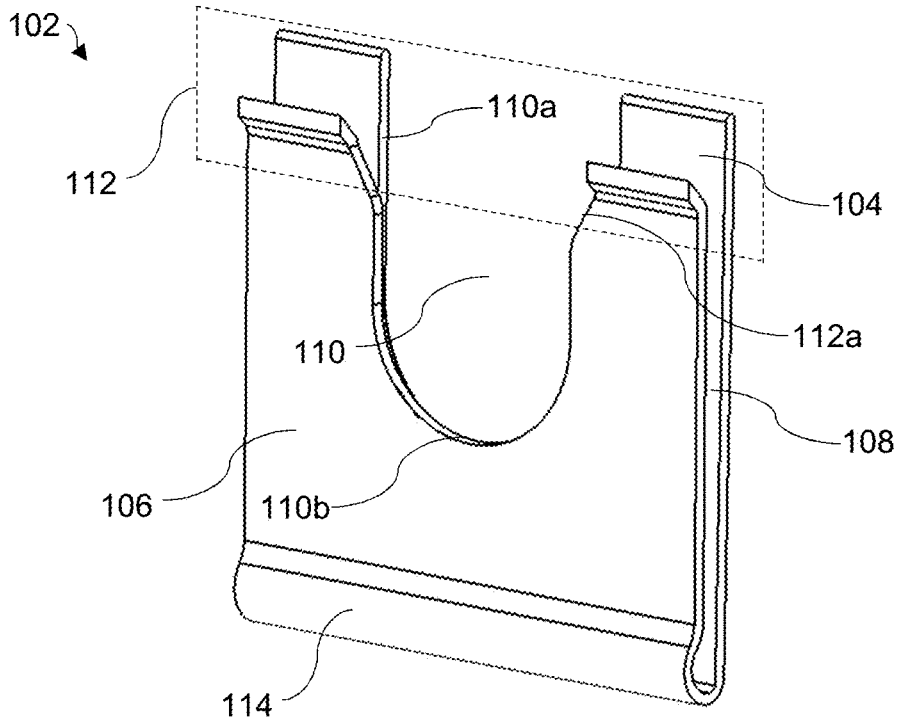
FIG. 1 is a perspective view of an example retention clip of an example supply retainer.

Imaging devices may perform imaging operations on or with media, sometimes referred to as print media. Imaging devices may use an imaging substance to perform such imaging operations. The imaging substance may be disposed in an imaging device supply, which may be contained within the imaging device, or attached to the imaging device. In some situations, the imaging device supply may be disposed remotely relative to the imaging device, and coupled to the imaging device through the use of fluid and electrical connectors and/or various plumbing components. The imaging device supply may be installed or coupled to the imaging device in order for the imaging substance within the supply to be utilized by the imaging device. Upon depletion or expiration of the imaging substance within the supply, the imaging device supply may be removed from engagement with the imaging device and replaced with a new, refreshed, or refilled imaging device supply.

Imaging device supplies may include a spout, spigot, valve, neck, or another type of connector to engage with a complementary connector on the imaging device in order to enable fluid communication between the imaging device and the imaging substance within the imaging device supply. Additionally, the imaging device supply may include a bladder or another malleable or flexible container to hold the imaging substance within the supply. Such a flexible bladder or container may be attached to the spout or other connector of the supply such that, upon pushing the spout, the flexible nature of the bladder may allow the spout to twist, translate, rotate, deflect inwards towards the bladder, and otherwise move in a variety of directions. Therefore, in some situations, attempts to couple the spout to the complementary connector of the imaging device may cause such movement of the spout and may make it difficult and tedious to successfully couple the supply to the imaging device. For example, a user may have to physically reorient the imaging device supply, a connector of the imaging device, or even the imaging device itself in order to successfully couple the spout of the supply to the imaging device.

In some situations, it may be desirable to prevent a spout or other connector of an imaging device supply from deflecting, rotating, or otherwise moving significantly while attempting to couple the imaging device supply to an imaging device. Further, it may be desirable to accomplish this while keeping manufacturing and/or assembly of the imaging device supply easy and/or simple to avoid increases in assembly time and/or cost.

Implementations of the present disclosure provide supply retainers for imaging device supplies that hold a spout or other connector of the supply in place to a sufficient degree so as to enable easier coupling of the supply to an imaging device. Further, implementations of the present disclosure provide supply retainers that may enable simple and/or easy assembly or manufacturing of the imaging device supply without enabling significant movement of the spout relative to the rest of the imaging device supply. Thus, implementations described herein may provide easily assembled and/or manufactured imaging device supplies that may be coupled to imaging devices without undue effort or difficulty, thereby increasing quality of user experience.

Referring now to FIG. 1, a perspective view of an example retention clip 102 of an example supply retainer is illustrated. Retention clip 102 may include a first wall 104 and a second wall 106. Second wall 106 may be spaced apart from the first wall 104 so as to define a carton slot 108 in between the first wall 104 and the second wall 106. The carton slot 108 may receive a dividing wall of a carton, in some implementations. In further implementations, the retention clip 102 may include a leading edge 112 and a trailing edge 114. In yet further implementation, the retention clip 102 may be constructed of a material with a U-shaped, V-shaped, or another cross-section having an open end to define the leading edge 112, and a closed end to define the trailing edge 114. Thus, the retention clip 102 may slide on to the dividing wall of the carton from the leading edge 112 until the dividing wall reaches the trailing edge 114, or any point therebetween. In some implementations, the leading edge 112 of the retention clip 102 may have flared geometry or structure as illustrated so as to help facilitate the retention clip 102 sliding on to the dividing wall, or another component.

The retention clip 102 may also include a retention opening 110 extending through the first wall 104 and the second wall 106. In some implementations, the retention opening may be an aperture, cutout, or slot extending through the retention clip 102. The retention opening 110 may extend to the leading edge 112 of the retention clip, such that the retention opening 110 is open on one side and closed on the other side. In further implementations, the retention opening may be substantially U-shaped, or may have another shape or profile that is open on one end and closed on the other. In some implementations, the retention opening 110 may be defined by a first U-shaped opening 110*a* in the first wall 104 and a second U-shaped opening 110*b* in the second wall 106, which may be aligned with the first U-shaped opening 110*a*. In some implementations, one of the U-shaped openings may be narrower in at least one dimension than the other U-shaped opening so as to better engage with a spout or other fluid connector of an imaging device supply.

The retention opening 110 may receive the spout or other connector of an imaging device supply, or a supply bladder thereof, and may engage with a shoulder or another retaining surface of such a spout or other connector so as to prevent the spout from being moved out of the retention opening 110 along an axis of the spout. In other words, the retention opening 110 may engage with the spout so as to prevent the spout from passing or slipping through the retention opening 110. In some implementations, the retention opening 110 may receive the spout from the open end of the retention opening 110, which may be at the leading edge 112. In other words, the retention clip 102 may slide on to the spout, or vice versa, starting with the leading edge 112, such that the spout is engaged with or retained within the retention opening 110. Additionally, the first wall 104 and/or the second wall 106 may include chamfered, angled, or otherwise wider edges 112*a* on the retention opening 110 near the leading edge 112 as illustrated. Such wider edges 112*a* may prevent the retention opening 110 from getting caught on features of the spout, for example, a rib, ledge, or shoulder of the spout, as the retention clip 102 is slidably engaging with the spout. Such wider edges 112*a* may also avoid a situation in which flared geometry of the leading edge 112 may need to compress or deform in order to fit within a channel or under a rib or shoulder of the spout as the retention clip 102 is slidably engaged with the spout.

Figure 2A:
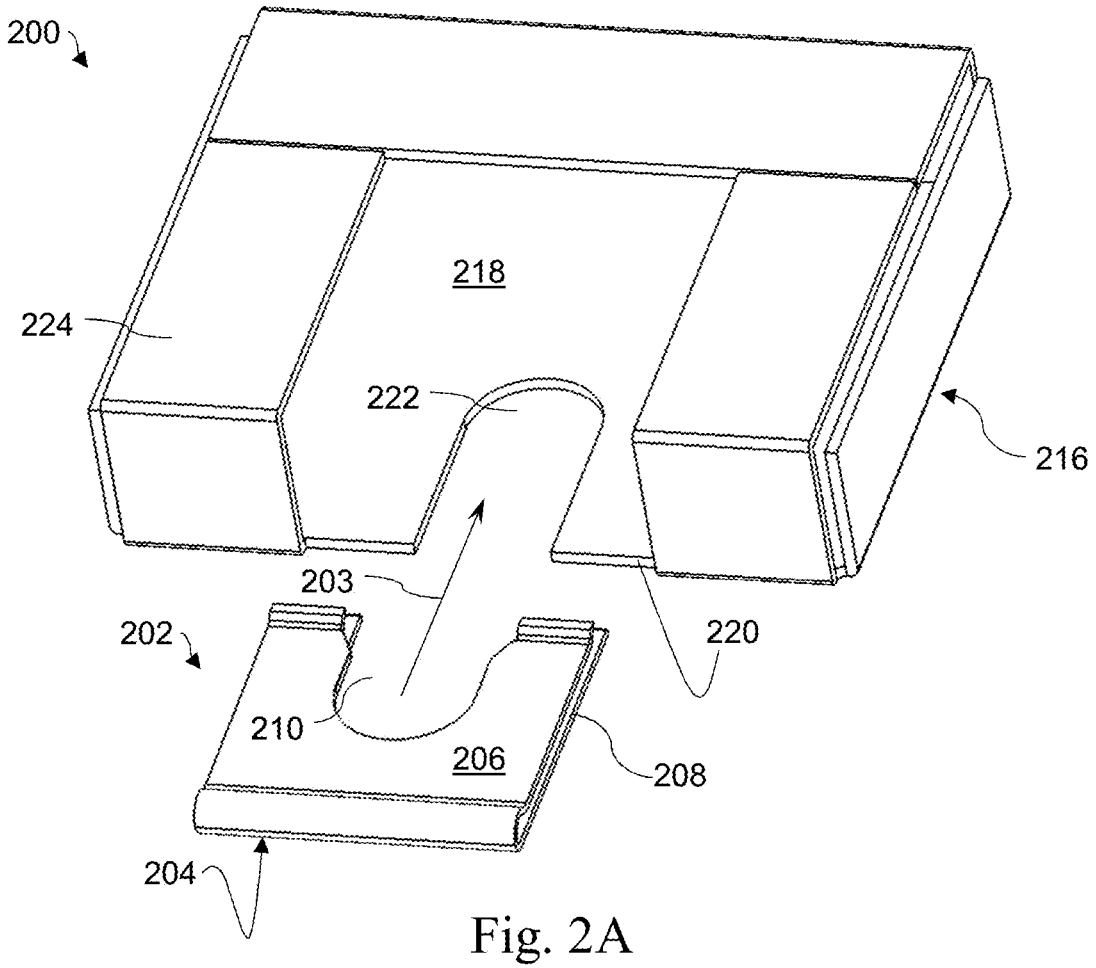
FIG. 2A is an exploded perspective view of an example supply retainer.

Referring now to FIG. 2A, a perspective view of an example supply retainer 200 is illustrated. Example supply retainer 200 may include an example retention clip 202, which may be similar in structure and/or function to retention clip 102. Supply retainer 200 may further include a carton 216 having a spout opening 222 extending to a base edge 220 of the carton. In some implementations, the spout opening 222 may extend through a dividing wall 218 of the carton 216 and may extend to the base edge 220 so as to form an open-ended aperture, cutout, or slot. In further implementations, the spout opening 222 may be U-shaped, or have another shape or profile that is open on one end. The spout opening may receive a spout of a supply bladder, in some implementations. The carton 216 may be a rigid or semi-rigid structure and include a dividing wall 218 to engage with the retention clip 202. The carton 216 may also have additional walls 224 or other structure to define an interior volume, sometimes referred to as a connection volume. In other implementations, the carton 216 may have a different appearance or structure. In yet further implementations, the carton 216 may comprise cardboard, corrugated cardboard, or another material.

Figure 2B:
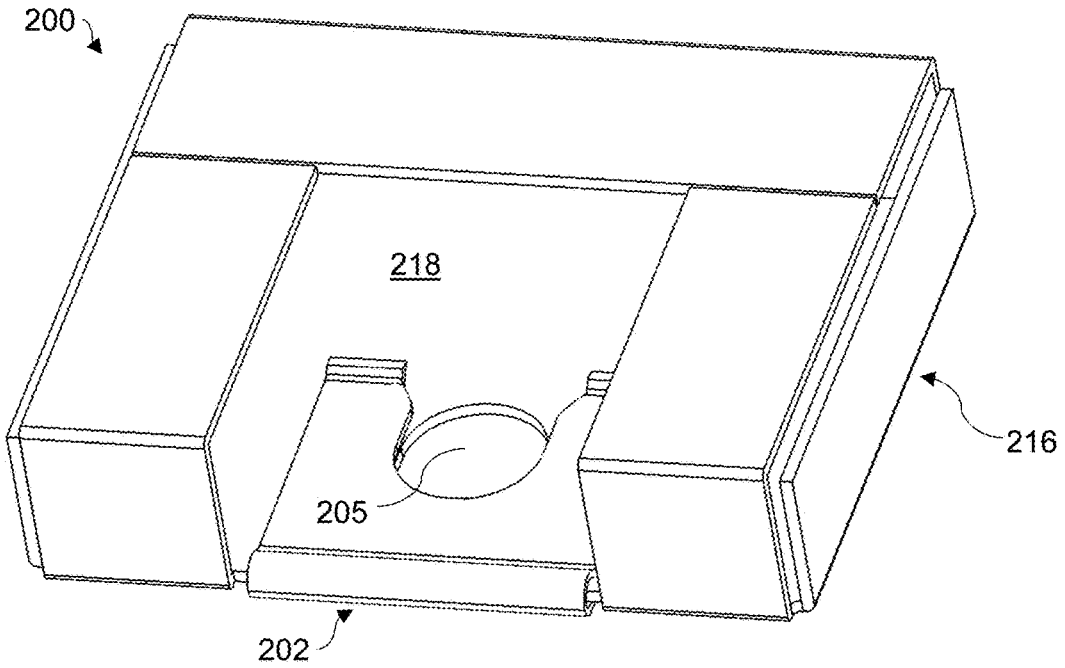
FIG. 2B is a perspective view of an example supply retainer.

The retention clip 202 may have a retention opening 210 extending to a leading edge of the retention clip 202 to receive and retain the spout. The retention opening 210 may extend through the entire thickness of the retention clip 202. Thus, the retention opening 210 may extend through a first wall 204 and a second wall 206 of the retention clip 202. The first wall 204 and the second wall 206 may be spaced apart so as to define a carton slot 208. The carton slot 208 may slidably engage with the dividing wall 218 of the carton 216 so as to align the spout opening 222 and the retention opening 210 such that the spout may be disposed through the spout opening 222 and the retention opening 210. In other words, the retention clip 202 may slide on to the carton 216 (for example, along direction 203) or the dividing wall 218 thereof. The base edge 220 of the carton 216 may slide into the carton slot 208 at the leading edge of the retention clip 202 until the dividing wall 218, or a sufficient portion thereof, is disposed within the carton slot 208. Referring additionally to FIG. 2B, a perspective view of the example supply retainer 200 is illustrated wherein the retention clip 202 is assembled on to the carton 216. It should be noted that, although illustrated as being completely slid onto the dividing wall 218, the retention clip 202 may be assembled on to the carton 216 to a different extent, or only to the extent that the retention opening 210 and the spout opening 222 define an aperture that is sized sufficiently to receive and retain the spout.

Figure 2C:
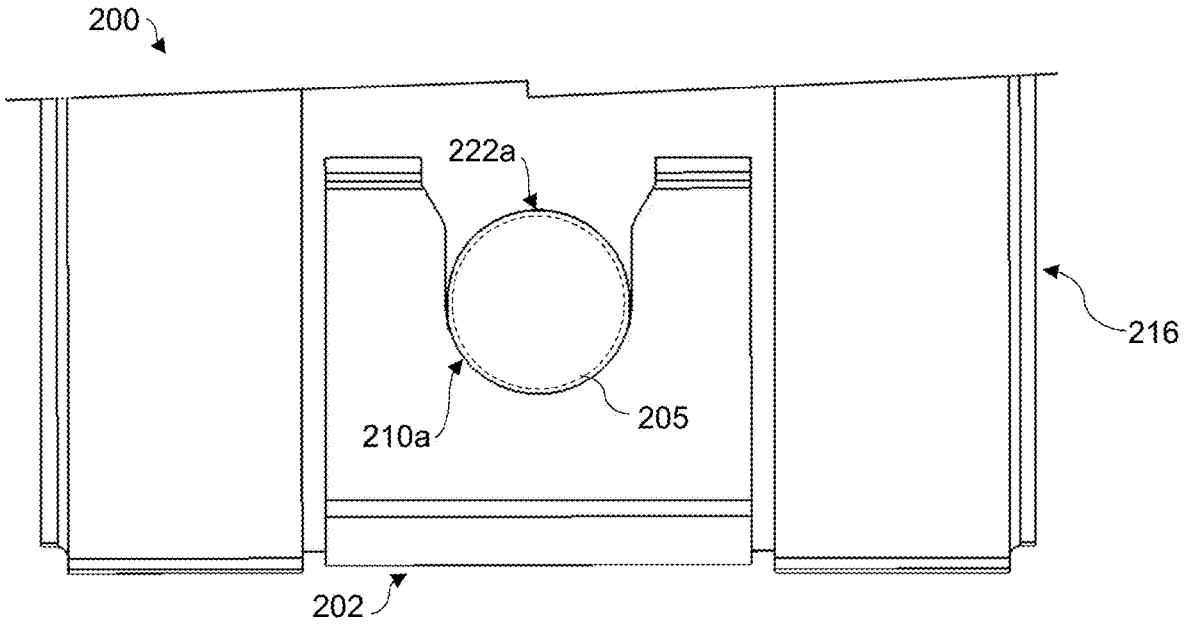
FIG. 2C is a top view of an example supply retainer.

Referring additionally to FIG. 2C, a top view of the example supply retainer 200 is illustrated. In some implementations, the spout opening 222 and the retention opening 210 may both be U-shaped and may be opposing to each other. Upon the retention clip 202 being assembled on to the carton 216, the spout opening 222 and the retention opening 210 may be opposing to each other so as to define a constrained opening having a closed perimeter (represented by phantom line 205) if the retention clip 202 is engaged with the carton. In other words, the open ends of the retention opening 210 and the spout opening 222 may approach and overlap each other as the retention clip 202 is assembled on to the carton 216 such that a closed perimeter constrained opening 205 is defined. Such closed perimeter 205 may therefore be defined by retention edge 210*a* of the retention opening 210 and a spout edge 222*a* of the spout opening. In some implementations, the first wall 204 and the second wall 206 may each have an opening or cutout to collectively define the retention opening 210. Thus, the closed perimeter 205 in such an implementation may be defined by a first retention edge of the first wall 204 and a second retention edge of the second wall 206, along with the spout edge 222*a*.

Figure 3A:
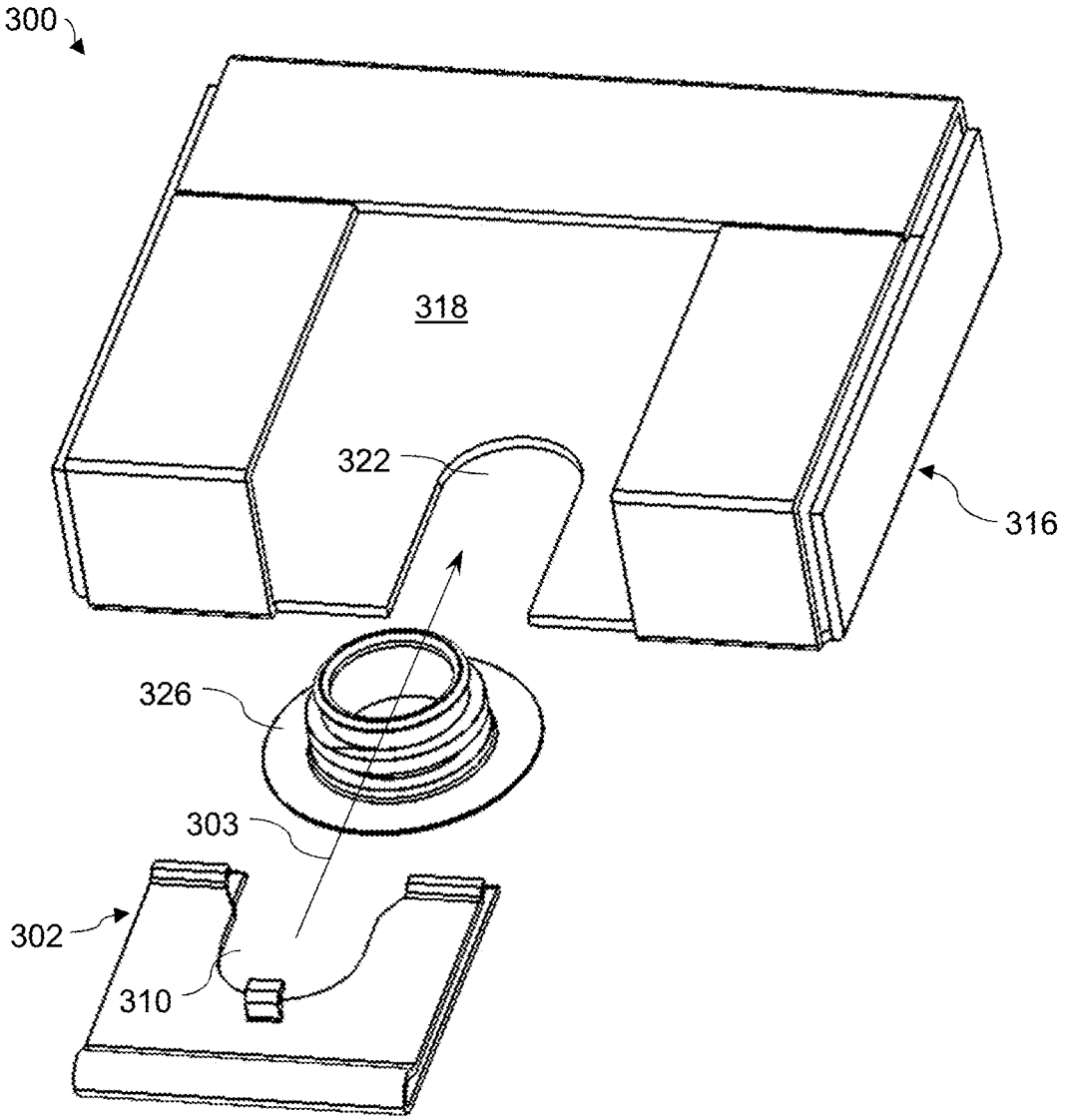
FIG. 3A is an exploded perspective view of an example supply retainer.

Referring now to FIG. 3A, an exploded, perspective view of an example supply retainer 300 is illustrated, wherein the supply retainer 300 is assembled with an example spout 326 of an imaging device supply, or a supply bladder thereof. Example supply retainer 300 may be similar to other example supply retainers described above. Further, the similarly-named elements of example supply retainer 300 may be similar in function and/or structure to the respective elements of other example supply retainers, as they are described above. In some implementations, the supply retainer 300 may include a retention clip 302 and a carton 316, which may both engage with the spout 326 so as to retain the spout 326. The spout 326 may be a spigot, valve, neck, fluid connector, or another type of connector attached to an imaging device supply such that imaging substance within the imaging device supply may flow out of the supply through the spout 326. Spout 326 may be illustrated as being an isolated component in FIGS. 3A-3C for clarity, but spout 326 may actually be fixed or attached to an imaging device supply, or another component thereof, such as a bladder, for example. The spout 326 may slidably engage with the carton 316, and/or a spout opening 322 thereof. Further, the retention clip 302 may slide (for example, along direction 303) on to the carton 316, or a dividing wall 318 thereof, such that a retention opening 310 is aligned with the spout opening 322, and thus the spout 326. The spout opening 322 and the retention opening 310 may each be smaller or narrower in width than at least one radial feature, for example a rib, ledge, shoulder, or other radially-extending feature, of the spout 326 in order to retain the spout 326. Therefore, the spout 326 may be disposed in between, and thus retained by both the spout opening 322 and the retention opening 310, as illustrated in FIG. 3B.

Figure 3B:
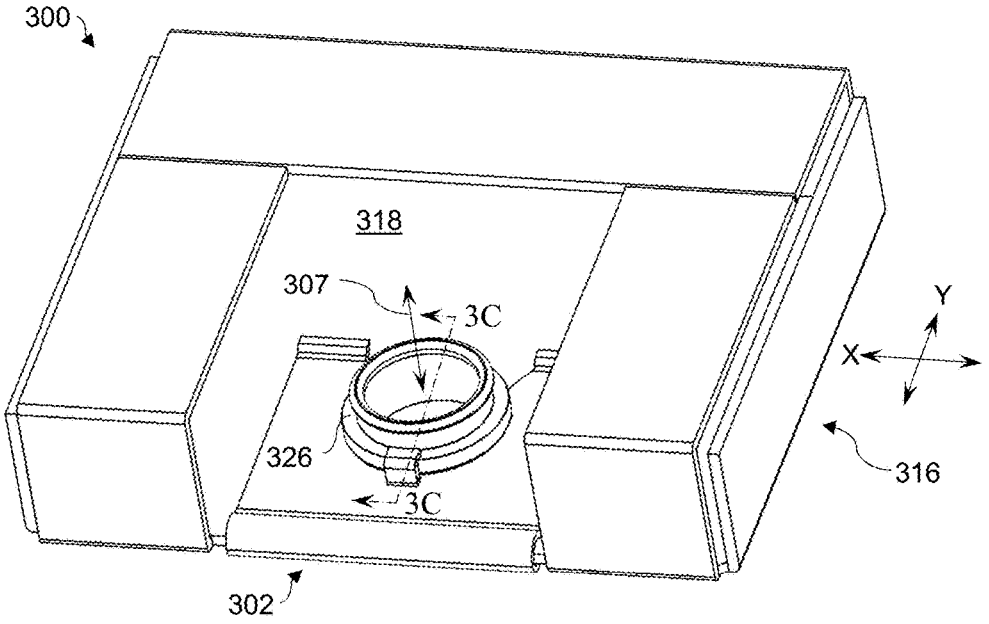
FIG. 3B is a perspective view of an example supply retainer.

Referring now to FIG. 3B, a perspective view of the example supply retainer 300 is illustrated wherein the spout 326 is engaged with and retained by the carton 316 and the retention clip 302. Upon the supply retainer 300 being assembled on to the spout 326, the supply retainer 300 may retain the spout 326 and prevent the spout 326 from moving along the X-direction, the Y-direction, and the Z-direction (represented by arrow 307). The spout opening 322 and the retention opening 310 may define a closed perimeter opening or aperture within which the spout 326 may be retained. Therefore, the spout opening 322 and the retention opening 310 may collectively surround the spout 326 and prevent the spout 326 from translating and rotating along the X-direction and the Y-direction. In some implementations, the spout opening 322 and/or the retention opening 310 may engage with a shoulder or other feature of the spout 326 so as to prevent the spout 326 from moving in and out along the Z-direction, represented by direction 307. Direction 307 may also be sometimes referred to as an axis of the spout 326. The retention clip 302 may include a first wall and a second wall with a carton slot disposed in between them to receive the dividing wall 318 as the retention clip 302 slidably engages with the carton 316. As such, the double-walled nature of the retention clip 302 may add additional strength to the carton 316 and help resist deflection or flexing of the dividing wall 318 along direction 307 in response to a force being exerted on the spout 326.

Figure 3C:
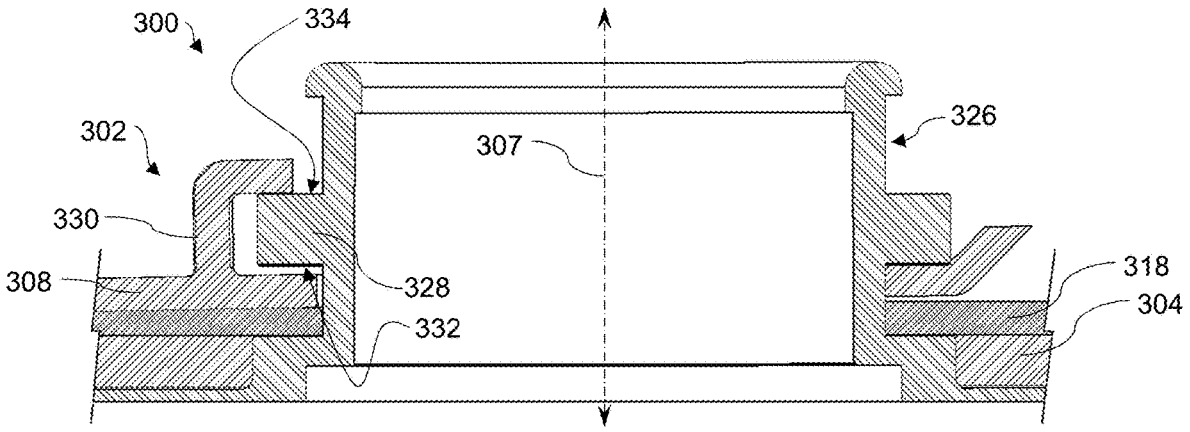
FIG. 3C is a cross-sectional view of an example supply retainer.

Referring now to FIG. 3C, a cross-sectional view of the example supply retainer 300 taken along view line 3C-3C of FIG. 3B is illustrated. The retention clip 302 may include a holding lug 330 extending from the second wall 308 and away from the carton slot. The holding lug 330 may be disposed on the retention clip 302 so as to engage with a ledge 334 of the spout 326. In some implementations, the spout 326 may include a rib 328 or other suitable feature that defines the ledge 334, as well as a shoulder 332. The holding lug 330, in further implementations, may have an L-shape, a J-shape, or another suitable cross-sectional shape and structure so as to be able to engage with the rib 328 of the spout, and/or the ledge 334 thereof. The rib 328 may be disposed in between the second wall and the holding lug 330 if the spout 326 is fully engaged with the retention opening 310. Thus, the holding lug 330 may engage with the ledge 334 of the rib 328, and the second wall 308 may engage with the shoulder 332 of the rib 328 such that the retention clip 302 prevents the spout 326 from moving along the Z-direction, represented by arrow 307.

In some implementations, the first wall 304 may have a first U-shaped opening and the second wall 308 may have a second U-shaped opening, wherein the first U-shaped opening and the second U-shaped opening collectively define the retention opening. In further implementations, the second U-shaped opening may be narrower than the first U-shaped opening so as to engage with the shoulder 332 of the spout 326 and, at least partially, prevent the spout 326 from moving along direction 307.

Figure 4A:
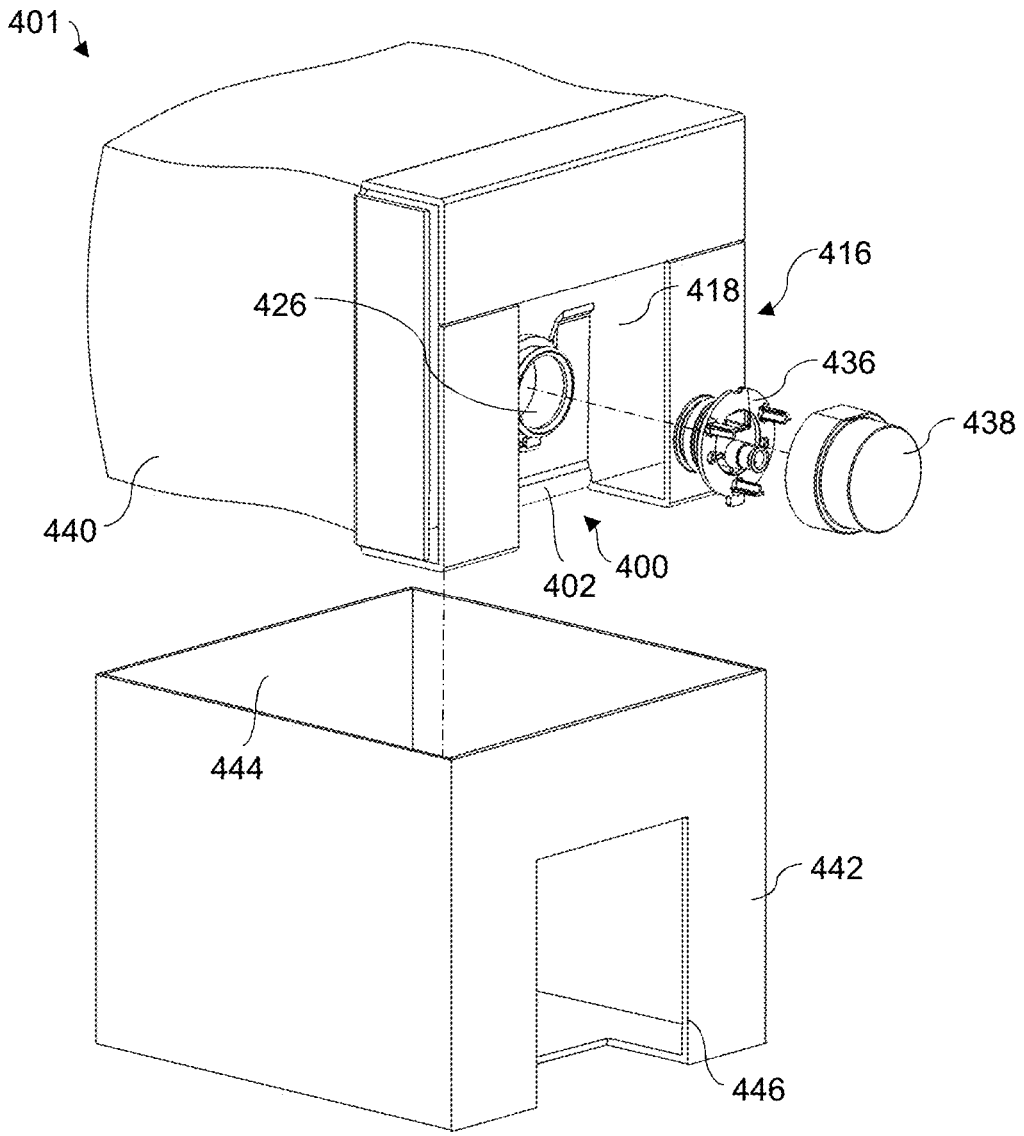
FIG. 4A is an exploded perspective view of an example imaging device supply having an example supply retainer.
Figure 4B:
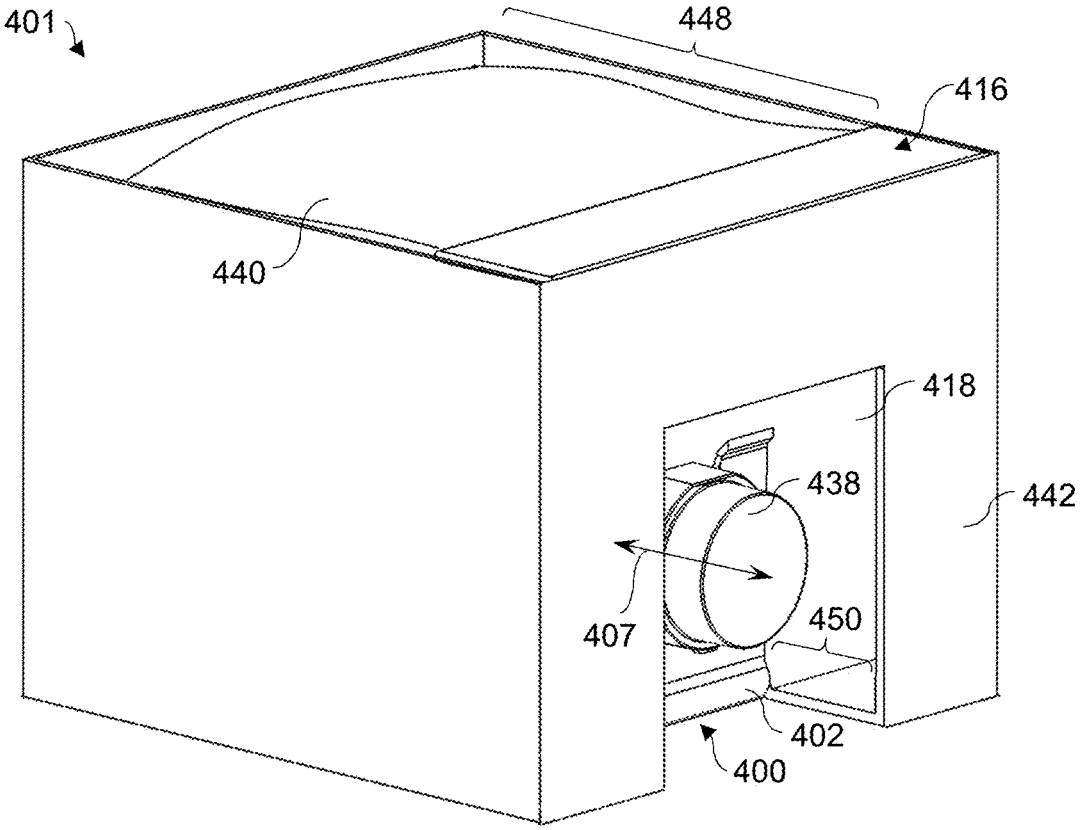
FIG. 4B is a perspective view of an example imaging device supply having an example supply retainer.

Referring now to FIGS. 4A and 4B, an exploded perspective view and a perspective view of an example imaging device supply 401 is illustrated, respectively. The example imaging device supply 401 may include an example supply retainer 400. Example supply retainer 400 may be similar to other example supply retainers described above. Further, the similarly-named elements of example supply retainer 400 may be similar in function and/or structure to the respective elements of other example supply retainers, as they are described above. Further, the imaging device supply 401 may include a container 442 and a supply bladder 440 disposed within the container 442 and including a spout 426. The container 442 may be a rigid or semi-rigid housing, case, or other structure suitable to support and contain the supply bladder 440 and imaging substance disposed within. In some implementations, the container 442 may include an access cutout 446 to provide access to the spout 426 of the supply bladder 440 when the supply bladder 440 is disposed within the container 442. The supply bladder 440, in some implementations, may be a malleable or flexible structure to hold or contain an imaging substance. In some implementations, the imaging substance may be a print substance, such as ink, for example, and the supply bladder 440 may be liquid-tight so as to prevent the ink from leaking out. In other implementations, the imaging substance may be a three-dimensional (3D) print substance, such as a powder or support material for use therein. The spout 426 may be fluidly coupled to an interior of the supply bladder 440 such that imaging substance may be able to flow out or be drawn or pumped out of the supply bladder 440 through the spout 426. In some implementations, the supply bladder 440 may further include a key cap 436 engaged with, or disposed on or in the spout 426. The key cap 436 may be a device or structure to detachably couple the supply bladder 440 to an imaging device, and/or to enable the spout 426 to fluidly communicate with the imaging device. In some implementations, the key cap 436 may include a valve or valves, or other fluidic components. In this context, imaging device may refer to a device that may perform imaging operations on or with media, sometimes referred to as print media. Such an imaging device may be a printer, copier, fax machine, scanner, all-in-one multi-function device, a 3D printer (additive manufacturing device) or another device that may benefit from having an example supply retainer employed thereon.

In some implementations, the supply retainer 400 may include a retention clip 402 and a carton 416. The carton 416 may be disposed in the container 442 and may have a dividing wall 418 to separate, partition, or divide an interior volume of the container 442 into a supply volume 448 and a connection volume 450. The supply volume 448 may be the portion of the interior volume that may contain or hold the portion of the imaging device supply that contains imaging substance, for example, the bladder 440. The connection volume 450 may be the portion of the interior volume that may contain or hold fluid and/or electrical connections for operably engaging or attaching the imaging device supply 401 to an imaging device. The carton 416 may further include a spout opening extending through the dividing wall 418 and extending from a base edge of the carton 416. The spout 426 may extend from the bladder 440, which may be disposed in the supply volume 448, through the spout opening and into the connection volume 450. The retention clip 402 may engage with the carton 416, or the dividing wall 418 thereof, and may include a retention opening extending through the retention clip 402 and extending from a leading edge of the retention clip 402. The retention opening may align with the spout opening so as to define a closed perimeter constrained opening. Such a closed perimeter constrained opening may thus receive the spout 426 and retain the spout 426 within the connection volume 450, and prevent the spout 426 from being pushed or pulled back into the supply volume 448. The retention clip 402 and the retention opening, along with the carton 416 and the spout opening, may, thus, retain the spout 426 in a sufficiently secure manner so as to prevent the spout 426 from moving along example direction 407, as well as prevent the spout 426 from translating in horizontal or vertical directions, lateral to direction 407. Further, such a secure holding of the spout 426 may prevent the spout 426 from moving relative to the carton 416 and/or container upon a user attempting to couple the spout 426 to an imaging device. Therefore, coupling the imaging device supply 401 to the imaging device may be easier and more efficient than if the spout 426 were allowed a higher degree of freedom of motion. Obtaining such a tight fitment of the spout 426 may still be accomplished by a simple and easy assembly and manufacturing process of the imaging device supply due to the sliding nature of the retention clip 402. A tight fit around the spout 426 can therefore be obtained without having to force the spout through a tightly-sized hole during the assembly process, which can be difficult, time consuming, and/or expensive.

Figure 4C:
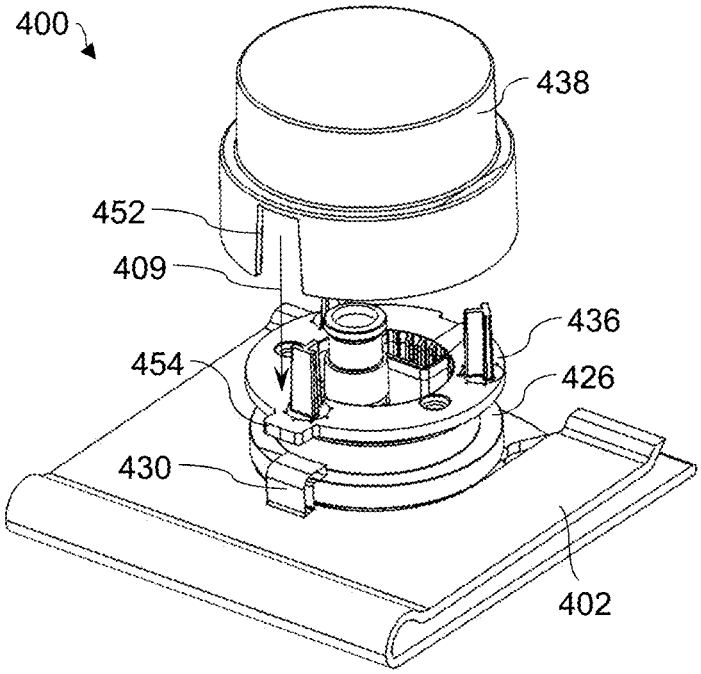
FIG. 4C is a perspective view of an example supply retainer.
Figure 4D:
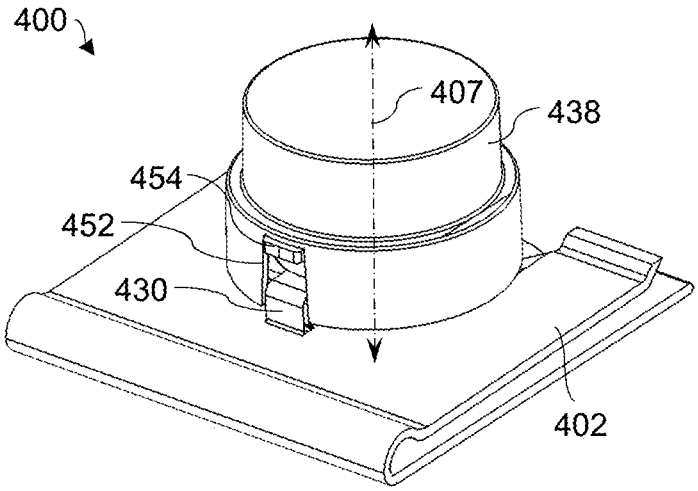
FIG. 4D is a perspective view of an example supply retainer.

Referring now to FIGS. 4C and 4D, partial perspective views of the example supply retainer 400 is illustrated. For clarity, other components of imaging device supply 401 have been omitted. The supply retainer 400 may include a dust cap 438 to engage with the spout 426 so as to cover and/or protect the key cap 436. The key cap 436 may be fixed within or on the spout 426 such that the spout 426 and the key cap 436 may be prevented from rotating relative to each other about an axis of the spout 426 (for example, about direction 407). The dust cap 438 may include a rotation notch 452 to engage with a rotation tab 454 of the key cap so as to prevent the spout 426 from rotating relative to the dust cap 438. In other implementations, the retention clip 402 may further include a holding lug 430 which may be aligned with the rotation tab 454 of the key cap 436 if the spout 426 is engaged with the retention opening of the retention clip 402. Thus, when the dust cap 438 is assembled on to the spout 426 (for example, along direction 409), the rotation notch 452 may engage with the holding lug 430 and the rotation tab 454 so as to prevent the spout 426 from rotating about an axis of the spout 426 relative to the retention clip 402, and, thus, relative to the imaging device supply 401.

What is claimed is:

1. A retention clip of a supply retainer, the retention clip comprising:

a first wall;

a second wall spaced apart from the first wall;

a carton slot in between the first wall and the second wall, the carton slot to receive a dividing wall of a carton;

a retention opening extending through the first wall and the second wall and extending to a leading edge of the retention clip, the retention opening to receive a spout of a supply bladder and to engage with a shoulder of the spout to prevent the spout from being moved out of the retention opening along an axis of the spout; and a holding lug extending from the second wall to engage with a ledge of the spout, wherein the retention opening is defined by a first U-shaped opening in the first wall and a second U-shaped opening in the second wall, aligned with the first U-shaped opening.

2. The retention clip of claim 1, wherein the retention opening is U-shaped and is to receive the spout from the leading edge.

3. The retention clip of claim 1, wherein the second U-shaped opening is narrower than the first U-shaped opening so as to engage with the shoulder of the spout.

4. The retention clip of claim 3, the second wall and the holding lug defining a space to accommodate a rib of the spout when the spout is fully engaged with the retention opening, the rib defining the shoulder and the ledge.

5. A supply retainer comprising:

a carton including:

a base edge, a spout opening extending to the base edge to receive a spout of a supply bladder, and a dividing wall; and a retention clip including:

a leading edge, a retention opening extending to the leading edge to retain the spout, the retention opening opposed to the spout opening, a carton slot to slidably engage with the dividing wall to align the spout opening and the retention opening such that the spout may extend through the spout opening and the retention opening, and a holding lug extending away from the carton slot and aligned with a rotation tab of a key cap when the spout is engaged with the retention opening, the spout opening and the retention opening being U-shaped and defining a constrained opening having a closed perimeter when the retention clip is engaged with the carton.

6. The supply retainer of claim 5, further including a dust cap to engage with the spout and the key cap, the dust cap including a rotation notch to engage with the holding lug and the rotation tab to prevent the spout from rotating about an axis of the spout relative to the retention clip.

7. An imaging device supply comprising:

a container;

a supply bladder disposed within the container and including a spout;

a carton disposed in the container and including:

a dividing wall to divide an interior volume of the container into a supply volume and a connection volume, and a spout opening extending through the dividing wall and extending from a base edge of the carton, the spout extending from the bladder disposed in the supply volume through the spout opening into the connection volume; and a retention clip engaged with the dividing wall and including a retention opening extending through the retention clip and extending from a leading edge of the retention clip, the retention opening to align with the spout opening and to retain the spout within the connection volume.

8. The imaging device supply of claim 7, wherein the supply bladder further includes a key cap engaged with the spout, the key cap to couple the supply bladder to an imaging device.

9. The imaging device supply of claim 8, further including a dust cap to engage with the spout to cover the key cap, the dust cap including a rotation notch to engage with a rotation tab of the key cap to prevent the spout from rotating relative to the dust cap.

10. The imaging device supply of claim 9, wherein the retention clip further includes a holding lug aligned with the rotation tab, the rotation notch to engage with the holding lug to prevent the spout from rotating relative to the retention clip.

11. The imaging device supply of claim 7, wherein the supply bladder contains a print substance.

* * * * *